US006476558B2

(12) United States Patent
Sakamoto et al.

(10) Patent No.: US 6,476,558 B2
(45) Date of Patent: Nov. 5, 2002

(54) MODE CONVERTER AND GYROTRON TUBE PROVIDED WITH MODE CONVERTER FOR CONVERTING MODE OF MILLIMETER WAVES

(75) Inventors: Keishi Sakamoto, Hitachinaka (JP); Atsushi Kasugai, Ibaraki-ken (JP); Yoshika Mitsunaka, Otawara (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/864,883

(22) Filed: May 25, 2001

(65) Prior Publication Data

US 2002/0021095 A1 Feb. 21, 2002

(51) Int. Cl.[7] ..... H01J 25/00; H01P 1/16
(52) U.S. Cl. ..... 315/4; 333/21 R
(58) Field of Search ..... 315/3, 3.5, 4, 5, 315/5.28, 5.33, 5.38; 333/20, 21 A, 21 R, 227, 242, 248, 99 PL

(56) References Cited

U.S. PATENT DOCUMENTS

| | | | | | |
|---|---|---|---|---|---|
| 4,398,121 | A | * | 8/1983 | Chodorow et al. | 315/3 |
| 4,839,561 | A | * | 6/1989 | Ito | 315/3 |
| 4,890,117 | A | * | 12/1989 | de Ronde | 333/21 R |
| 4,999,591 | A | * | 3/1991 | Koslover et al. | 333/21 R |
| 5,015,914 | A | * | 5/1991 | Ives et al. | 315/4 |
| 5,187,409 | A | * | 2/1993 | Ito | 315/5 |
| 5,266,868 | A | * | 11/1993 | Sakamoto et al. | 315/5 |
| 5,266,962 | A | * | 11/1993 | Mobius et al. | 333/21 R |
| 5,719,470 | A | | 2/1998 | Hirata et al. | 315/5 |
| 5,734,303 | A | * | 3/1998 | Baca | 315/5 |
| 5,780,969 | A | * | 7/1998 | Sakamoto et al. | 315/5 |
| 5,818,170 | A | * | 10/1998 | Kikunaga et al. | 315/5 |

FOREIGN PATENT DOCUMENTS

| | | |
|---|---|---|
| EP | 426 855 | 5/1991 |
| JP | 3-504187 | 9/1991 |
| JP | 2892151 | 7/1992 |
| JP | 5-283015 | 10/1993 |
| JP | 7-254802 | 10/1995 |
| JP | 8-7775 | 1/1996 |
| JP | 2892151 | 5/1999 |

OTHER PUBLICATIONS

Sakamoto et al., "Development of 170 GHz/500 kW Gyrotron," International Journal of Infrared and Millimeter Waves, vol.18, No. 9, 1997, pp. 1637–1654.

* cited by examiner

*Primary Examiner*—Don Wong
*Assistant Examiner*—Minh D A
(74) *Attorney, Agent, or Firm*—Pillsbury Winthrop LLP

(57) ABSTRACT

In a substantially circular waveguide constituting a mode converter in a gyrotron tube, there is a region whose transverse inner surface shape changes to a non-true circular shape from a true circular shape in a range of 0 mm to 5 mm toward a radiation aperture from the incident side. Therefore, an undesirable cavity resonator which causes parasitic oscillation can be prevented from being formed in the vicinity of an inlet of the mode converter. Therefore, the parasitic oscillation of the mode converter can be suppressed, and a conversion efficiency of the converter can be enhanced, because of the effective length of the mode converter can be enhanced in the limited actual length.

12 Claims, 8 Drawing Sheets

MODE CONVERTER AND GYROTRON TUBE PROVIDED WITH MODE CONVERTER FOR CONVERTING MODE OF MILLIMETER WAVES

CROSS-REFERENCE TO RELATED APPLICATIONS

This application is based upon and claims the benefit of priority from the prior Japanese Patent Application No. 2000-158729, filed May 29, 2000, the entire contents of which are incorporated herein by reference.

BACKGROUND OF THE INVENTION

The present invention relates to a mode converter of millimeter waves, and a gyrotron tube provided with the mode converter for the millimeter waves.

As a method of heating plasma in nuclear fusion or the like, there is known a method of irradiating the plasma with electromagnetic waves of the millimeter waves band. As an oscillation source for oscillating the electromagnetic waves of the millimeter waves band, a gyrotron tube for oscillating the electromagnetic waves in a higher mode is known, and use of such gyrotrons in heating of the plasma can be promised.

Since the higher-mode electromagnetic waves oscillated by a cavity resonator in the gyrotron has a large transmission loss in a waveguide, the waves are regarded as unsuitable for lager power transmission via a transmission channel extending over several tens of meters to a nuclear fusion furnace from the oscillation source. Therefore, a method of converting the higher-mode millimeter waves to beam-like millimeter waves able to be propagated in a free space by a mode converter, and transmitting the waves in a quasi-optical manner has been studied.

As the mode converter for converting the higher mode millimeter waves to the beam-like waves, for example, in PCT National Publication No. 504187/1991 (International Publication No. WO90/07800), a converter having a waveguide is disclosed. The waveguide has a structure in which converging mirrors and diverging mirror are alternately disposed in helical shapes inside the circular waveguide. In the converter, the millimeter waves are scattered by diverging mirror portions and gradually converged by converging mirror portions, and finally the beam-like millimeter waves are projected from the last converging mirror. In the following description, this proposal will be referred to as prior art 1.

In the waveguide having concave/convex portions, the converging mirror corresponds to a region in which an inner surface shape of the waveguide is concave in an axial direction and convex in an azimutual or azimuthal direction. The diverging mirror corresponds to a region in which the inner surface shape of the waveguide is concave in both the axial direction and the azimutual direction.

The larger an energy density of the millimeter waves in the edge of an aperture for passing the millimeter waves are, the larger diffraction and scattering effect of the millimeter waves become.

In this respect, a distribution shape of the millimeter waves in the prior art 1 are closer to that of Gaussian beam, as compared with a conventional VLASOV type quasi-optical mode converter (e.g., Vlasov, S. N. et al., 1975, Radio Engineering and Electronic Physics, vol. 21, No. 10, pp. 14 to 17, or Wada, Hashimoto, Nakajima, Electronic Information Communication Society Technical Research Report Vol. 88, No. 67, MW88-8). Therefore, the millimeter waves power density in the edge of the aperture is lowered, and the diffraction and scattering effects of the millimeter waves can be expected to decrease.

However, in the prior art 1, there is no detailed description concerning the shape of the aperture. Additionally, it is supposed that the portion shape largely influences the diffraction and scattering effects of the millimeter waves. Moreover, the shape of the aperture is described in Jpn. Pat. Appln. KOKAI Publication No. 283015/1993.

Furthermore, another mode converter is disclosed in Jpn. Pat. Appln. KOKAI Publication No. 254802/1995. This mode converter is constituted by improving the prior art 1, reducing torsions of output millimeter wave shape and simplifying the structure, so that high manufacturing precision and low manufacturing cost can be realized. In the following description, the mode converter will be referred to as prior art 2.

For the mode converter disclosed in the prior art 1 or the prior art 2, in order to sufficiently shape the output waves and enhance a mode conversion efficiency, the converter needs to be long in the axial direction. It is described in the prior art 1 that a length of $3L_0$ or more is necessary in the axial direction. However, depending upon an input mode, a length of $10L_0$ or more is sometimes necessary in the axial direction in order to maximize the mode conversion efficiency. Here, $L_0$ denotes $2\times a\times \sin W/\tan B$.

When the mode converter is incorporated into a gyrotron tube, an electron beam used in oscillation by the cavity resonator is guided by a magnetic field, gradually expanded and passed through the mode converter. The length of the mode converter must be limited that the mode converter does not contact the electron beam. Because of this limitation, the length of the mode converter sometimes has to be shortened even by deteriorating the mode conversion efficiency.

On the other hand, the mode converter in the prior art 1 or 2 has a structure in which deformation gradually increases from the circular waveguide in an inlet. In the vicinity of the inlet with a distance of about 30 mm from an inlet side, the structure is similar to that of a linear circular waveguide. When the mode converter is incorporated inside the gyrotron tube, a straight circular waveguide portion serves as the cavity resonator and possibly causes a parasitic oscillation.

BRIEF SUMMARY OF THE INVENTION

An object of the present invention is to provide a mode converter with a high mode conversion efficiency, which has substantially no circular waveguide portion serving as an undesirable cavity resonator to minimize a parasitic oscillation, and a gyrotron tube provided with the mode converter.

According to the present invention, there is provided a mode converter, comprising a substantially circular waveguide having a transverse inner surface formed such that a deformation degree to a non-true circular from a true circular or a circular close to the true circular is gradually increased toward a radiation aperture side from an inlet side of higher-mode millimeter waves, for converting the higher-mode millimeter waves propagated in the substantially circular waveguide to the millimeter wave beams propagated in the space free, wherein a position starting the non-true circular transverse inner surface shape of the substantially circular waveguide is in a range of 0 to 5 mm toward the radiation aperture from the inlet side.

Moreover, according to the present invention, there is provided a gyrotron tube provided with the mode converter having the aforementioned structure.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A gyrotron tube according to a preferred embodiment of the present invention will be described hereinafter in detail with reference to the drawings.

Figure 1:
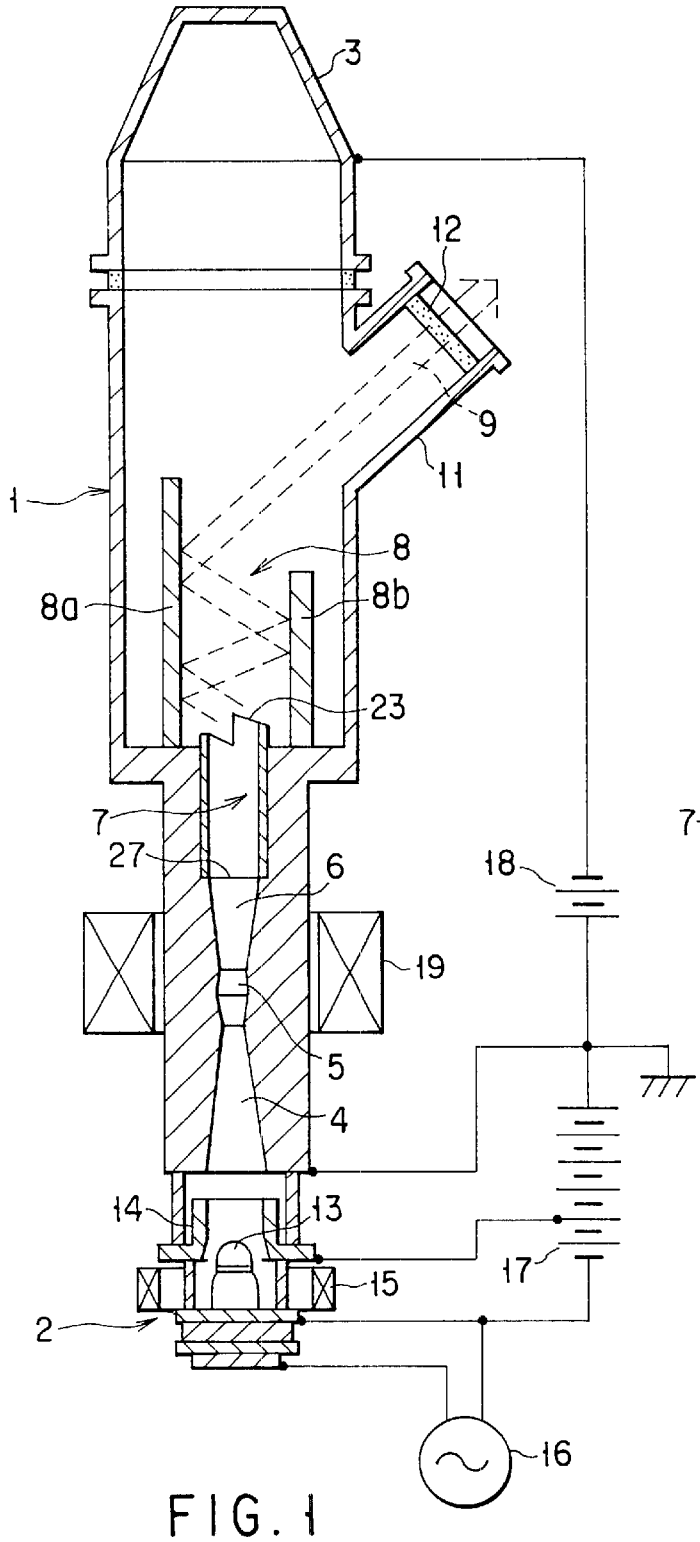
FIG. 1 is a sectional view schematically showing a gyrotron tube according to an embodiment of the present invention.

FIG. 1 is a longitudinal sectional view schematically showing the gyrotron tube with a mode converter incorporated therein according to the present invention. As shown in FIG. 1, in the gyrotron tube in which the mode converter is incorporated, a magnetron injection gun (hereinafter abbreviated as MIG) 2 for emitting an electron beam is received in one end portion of a tube 1 which is maintained at vacuum state.

Moreover, a collector 3 for collecting the electron beam emitted from the MIG 2 is received in the tube and disposed opposite to the MIG 2. A beam tunnel 4, cavity resonator 5, cylindrical tapered waveguide 6 and mode converter 7 which constitutes a high frequency propagation circuit is arranged in this order between the MIG 2 and the collector 3.

The MIG 2 includes a cathode 13 which is faced to the inside of the tube 1, a cylindrical anode 14 disposed around the cathode 13, and a magnet 15 for applying a magnetic field to a space between the cathode 13 and anode 14. Moreover, the cathode 13 is connected to a heater power supply 16. A high-voltage power supply 17 is connected between the cathode 13 and anode 14 and is also connected between the anode 14 and beam tunnel 4. Moreover, a high-voltage power supply 18 is connected between the beam tunnel 4 and collector 3. In the tube 1, a main magnet 19 is disposed to surround the cavity resonator 5.

In the gyrotron tube having the aforementioned structure, when the heater power supply 16 and high-voltage power supplies 17, 18 are turned on, an electron beam is helically emitted from the MIG 2 and is moved in a cylindrical form. The electron beam performs a cyclotron movement due to the magnetic field applied from the main magnet 19. The electron beams passing through the beam tunnel 4 is entered in the cavity resonator 5.

In the cavity resonator 5 defining an interaction space, the electron beam interacts with a high-frequency electric field, the motion energy of the electron beam is applied to the high-frequency electric field, and thereby the higher mode electromagnetic waves are generated in the interaction space. The motion energy of the electron beam is decrease in the interaction space and the electron beam is guided into the cylindrical tapered waveguide 6, mode converter 7 and mirror system 8. Finally, the electron beam is collected on the collector 3.

On the other hand, the electromagnetic waves generated in the interaction space are guided through the cylindrical tapered waveguide 6 into the mode converter 7 formed as the substantially circular waveguide. In the mode converter, the electromagnetic waves are converted into a beam-like electromagnetic waves propagated in the vacuum space, and the beam-like electromagnetic waves are incident upon the mirror system 8. The mirror system 8 is constituted of a pair of reflective mirrors 8*a*, 8*b* disposed opposite to each other. The beam-like electromagnetic waves repeats a quasi-optical reflection in the pair of reflective mirrors 8*a*, 8*b*, and is emitted to the output window 12 of the output waveguide 11. Subsequently, the electromagnetic waves 9 converted to the quasi-optical beam-like wave are extracted to the outside via the output window 12.

Additionally, in the conventional gyrotron tube, the mode converter 7 of the substantially circular waveguide is directly connected to the cylindrical tapered waveguide 6. The inlet side of the mode converter 7 is formed in a true circular shape over a remarkably long distance. Therefore, as described above, it is considered that this true circular region in the vicinity of the inlet side of the mode converter 7 constitutes an undesirable cavity resonator and possibly causes a parasitic oscillation.

Figure 2:
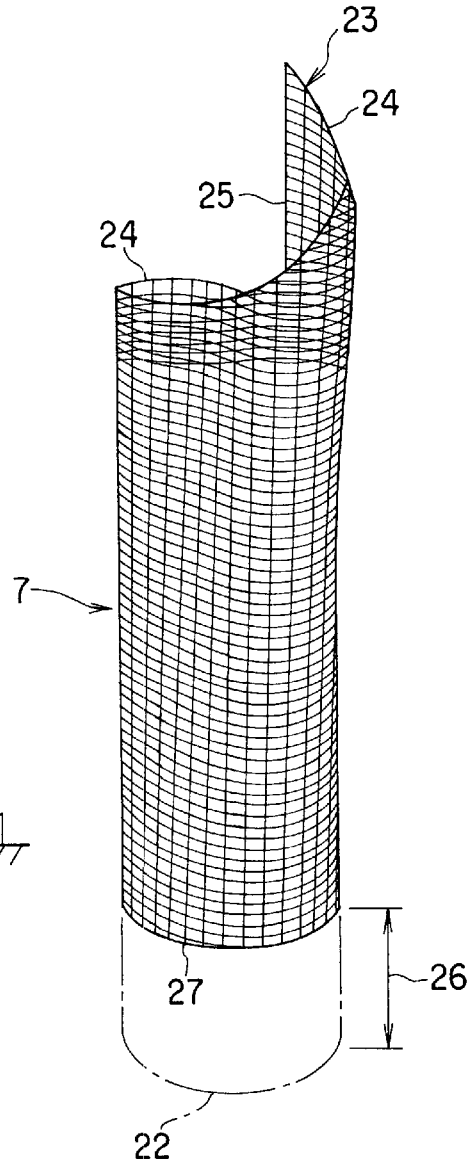
FIG. 2 is a perspective view showing a first example of a circular waveguide of a mode converter incorporated into the gyrotron tube shown in FIG. 1.

Different from the conventional gyrotron tube, the gyrotron tube according to the present invention is provided with the mode converter having no cavity resonator region shown in FIG. 2, so that the parasitic oscillation can be prevented.

Figure 3:
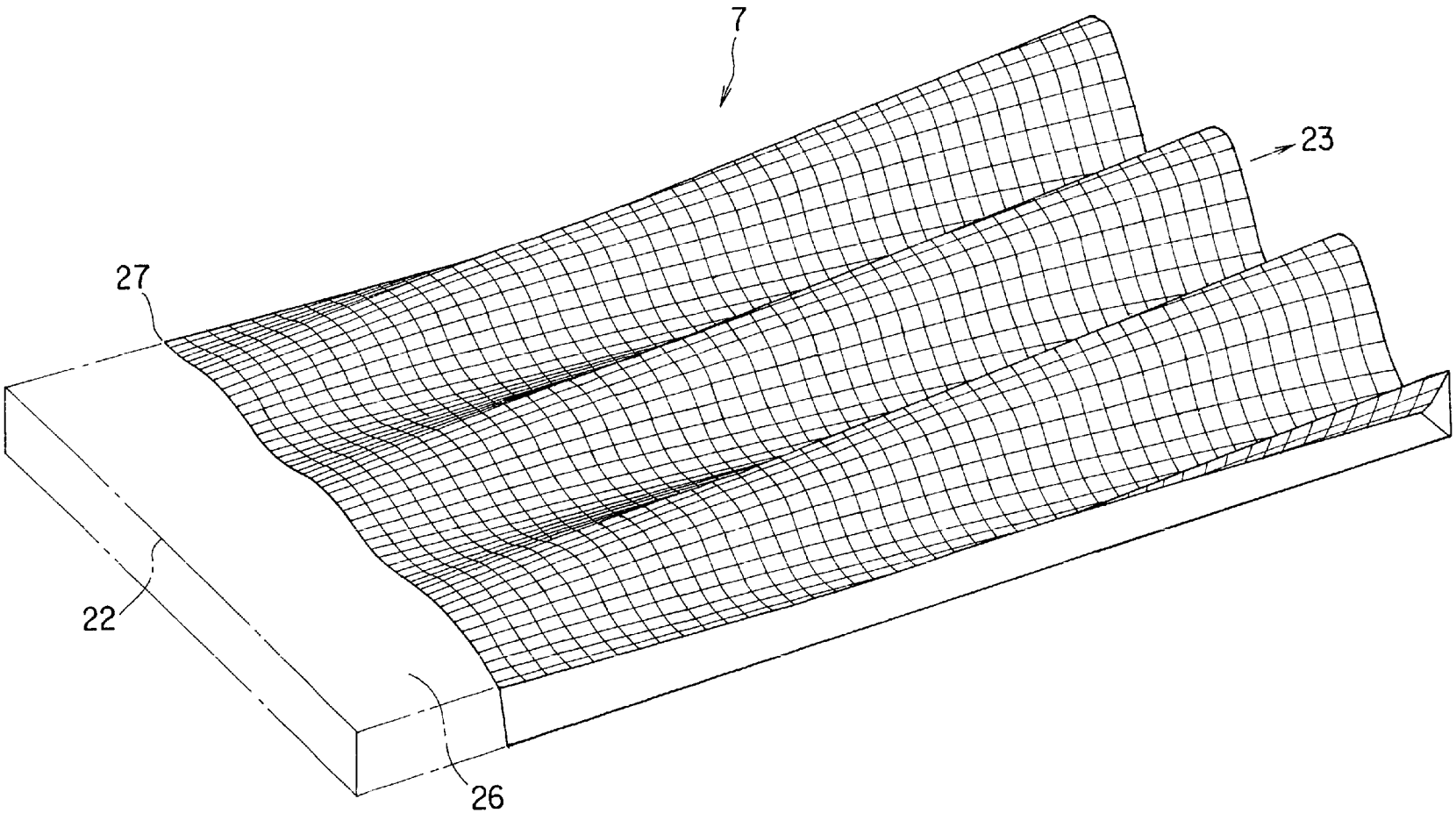
FIG. 3 is a diagram showing the circular waveguide of the mode converter shown in FIG. 2 in a developing manner in an azimutual direction.
Figure 4:
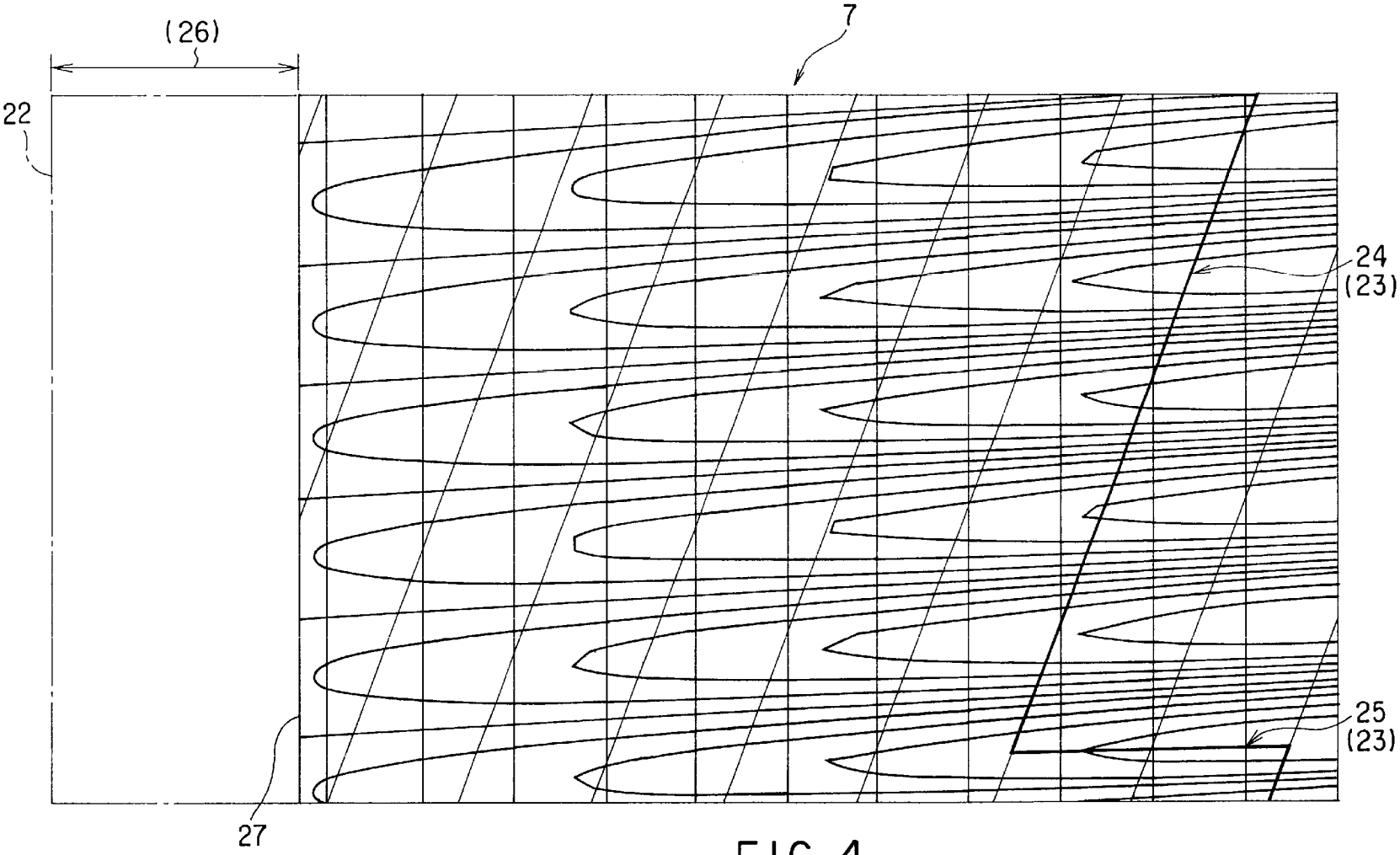
FIG. 4 is a plan view schematically showing a concave/convex state of the circular waveguide of the mode converter shown in FIG. 2 in the developing manner in the azimutual direction with contour lines.

The gyrotron tube according to a first embodiment of the present invention will be described hereinafter with reference to FIG. 2 to FIG. 8. FIG. 2 is a perspective view showing an inner surface shape of a substantially circular waveguide constituting the mode converter 7 incorporated into the gyrotron tube shown in FIG. 1, and shows a surface concave/convex state in an emphasizing manner with lines indicating a solid. Moreover, FIG. 3 is a developed diagram of a azimutual direction showing the concave/convex shape of the inner surface of the mode converter 7 shown in FIG. 2, and shows large/small radii indicating the concave/convex shape with contour lines. Furthermore, FIG. 4 is a plan view showing the inner surface shape of the mode converter 7 in the developing manner in the azimutual direction, and shows the concave/convex shape with the contour lines. Also in FIG. 4, the inner surface concave/convex shape is shown in an emphasized manner.

Figure 8:
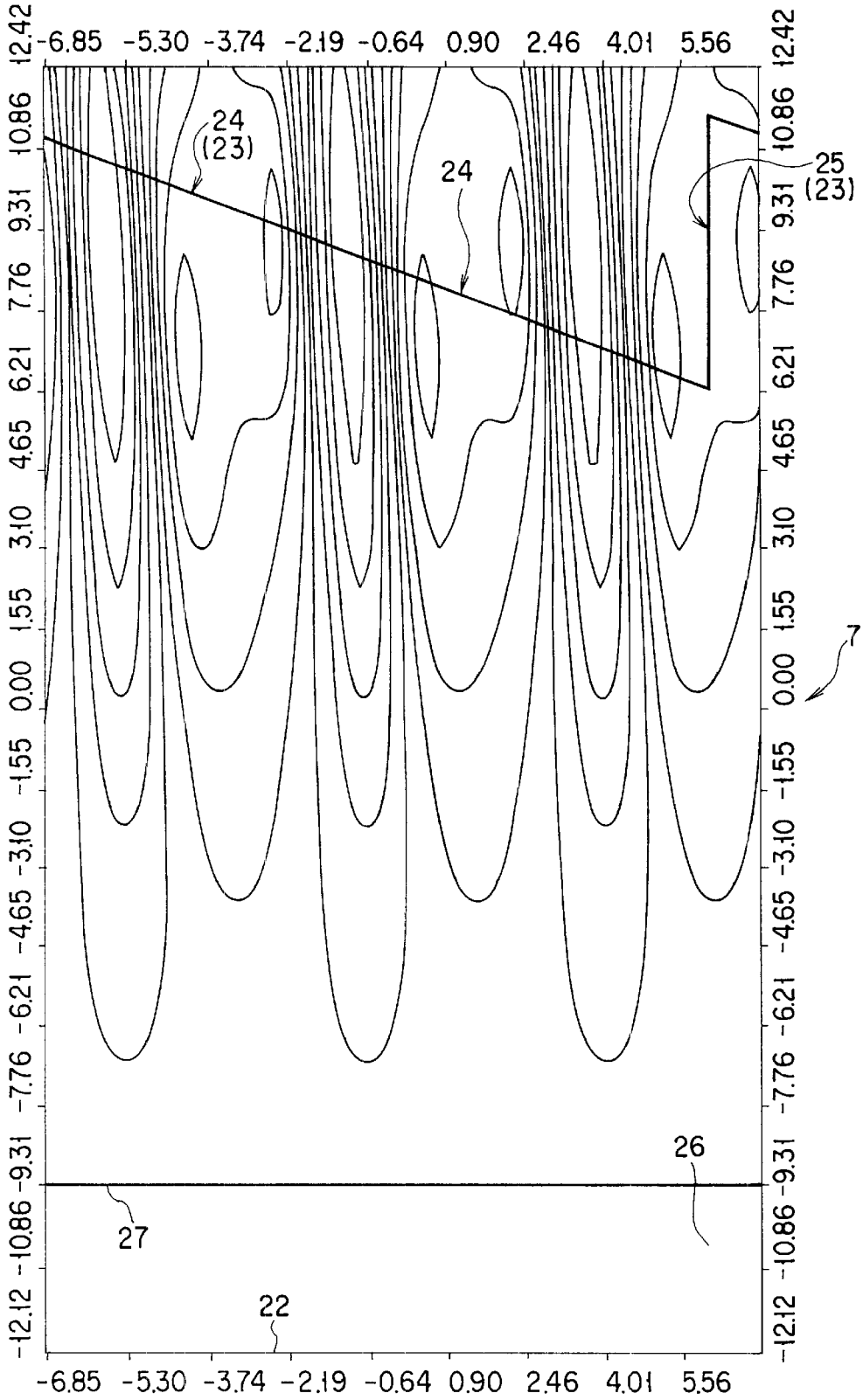
FIG. 8 is a plan view schematically showing an electric field distribution of millimeter waves on an inner surface of the circular waveguide in the mode converter shown in FIG. 2 with calculated values.

FIG. 8 is a distribution diagram showing an electric field strength distribution of millimeter waves on the inner surface of the mode converter. Additionally, in FIGS. 5A, 5B and 5C, the example of F(z) can also be applied to $F_1(z)$, $F_2(z)$ described later. Moreover, in FIG. 3, FIG. 4 and FIG. 8, to facilitate understanding of an action, even portions which do not actually exist are shown.

As shown in FIG. 2 to FIG. 4, the substantially circular waveguide constituting a main part of the mode converter 7 is a waveguide having a substantially cylindrical inner surface shape. As shown in FIG. 2, a transverse inner surface shape of a virtual inlet side 22 is formed in a true circular shape.

Moreover, for the inner surface shape of the substantially circular waveguide, the deformation degree to the non circular shape, i.e., the concave/convex shape from the true circular shape gradually increases along a propagation direction, that is, toward a radiation aperture 23 from an actual inlet side 27. Additionally, the radiation aperture 23 of the substantially circular waveguide constituting the mode converter 7 shown in FIG. 2 has a helical cut portion 24, and a linear cut portion 25 cut in a direction parallel to a tube axis. Moreover, a length of an axial direction of the substantially circular waveguide is, for example, about 230 mm. The longer the length is, the more a mode conversion efficiency increase. However, the length needs to be limited to such an extent that the waveguide does not contact the diverging electron beam.

The inlet side 27 of the substantially circular waveguide constituting the mode converter 7 is directly connected to the cylindrical tapered waveguide 6. The higher-mode millimeter waves inputted via the inlet side is converged by the concave/convex of a converter inner wall surface shown in FIG. 2 to FIG. 4, and emitted from the radiation aperture 23.

The transverse inner surface shape of the substantially circular waveguide constituting the mode converter 7 will next be described. Additionally, description concerning the shape is to be understood as the description concerning the transverse inner surface shape of the substantially circular waveguide, as far as not described otherwise.

While the virtual inlet side 22 of the substantially circular waveguide has a true circular shape, the actual inlet side 27 has a true circular shape or a non-true circular shape as described later. The waveguide is formed in such a manner that the true circular shape turns to the non-true circular shape in a range of 0 to 5 mm toward the radiation aperture 23 from the inlet side 27. The true circular shape is changed to the non-true circular shape in a specific position. On the inlet side of the substantially circular waveguide, the position in which the non-true circular transverse inner surface shape starts may be the actual inlet side 27 of the waveguide, or may be in a range of 5 mm toward the radiation aperture 23 from the inlet side 27.

Additionally, in actual, a cylindrical region 26 forming the actual inlet side 27 may be cutout and manufactured from the virtual inlet side 22 of the substantially circular waveguide having the true circular virtual inlet side 22. A cutout range is set to be appropriate dependent upon the operation frequency and input mode.

In the prior art 2, as described above, the inlet side of the mode converter is formed in a circular shape such that the inlet side is continuously and directly connected to the cylindrical tapered waveguide. Therefore, the region in the vicinity of the inlet side of the waveguide, that is, the cylindrical region 26 extending to the actual inlet side 27 from the virtual inlet side 22 as shown by a dotted line of FIG. 2 has a true circular shape or has a very small deformation degree from the true circular shape. An undesirable cavity resonator is possibly formed in the region and a parasitic oscillation is caused.

Therefore, as shown in FIG. 2 to FIG. 4, the region 26 in the vicinity of the inlet side of the mode converter 7 is cut, and the actual inlet side 27 is formed in a slightly non-true circular shape. Alternatively, the inlet side 27 is formed in the true circular shape, and the waveguide is formed to have a region in which the non-true circular shape starts in a range of 5 mm or less toward the radiation aperture 23 from the inlet side 27. In the waveguide according to one embodiment of the present invention, there is no true circular region, or the true circular region is limited to 5 mm or less from the inlet side 27. This can reduce a possibility that the region in the vicinity of the inlet side would be formed as the substantial cavity resonator and causes the parasitic oscillation. Additionally, when the actual inlet side 27 has the non-true circular shape, discontinuity occurs in a connection surface of the circular tapered waveguide. However, since the deformation degree from the true circular shape is small, it is possible to suppress a reflection caused by the discontinuity, or an influence caused by the mode conversion.

On the other hand, a total length of the mode converter limited by interference with an electron beam orbit is retained as the length excluding the length of the true circular region 26 on the inlet side. In this state, an effective length can be increased. Therefore, a deformation amount per unit length is small, the beam is moderately converged and the mode conversion efficiency can be improved.

As in the substantially circular waveguide constituting the mode converter 7, for the inner surface shape of the cylindrical waveguide whose deformation degree gradually increases in a propagation direction, when an inlet radius a, tube axial direction coordinate z, azimutual direction coordinate $\phi$, monotonous increase function F(z), constant H and integer n are used, a circular waveguide inner surface radius r can be represented by the following.

$$r=a+F(z)\cdot\cos(H\cdot z+n\cdot\phi)$$

Figure 5A:
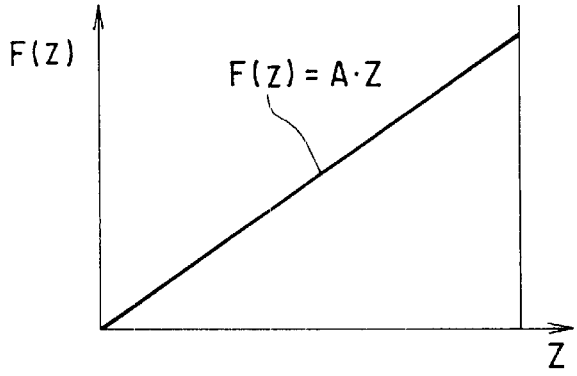
FIGS. 5A to 5C are graphs schematically showing examples of monotonous increase functions F(z), $F_1(z)$, $F_2(z)$ of the mode converter shown in FIG. 2.

Additionally, as shown in FIG. 5A, the monotonous increase function F(z) corresponds to:

$$F(z)=Az.$$

Figure 5B:
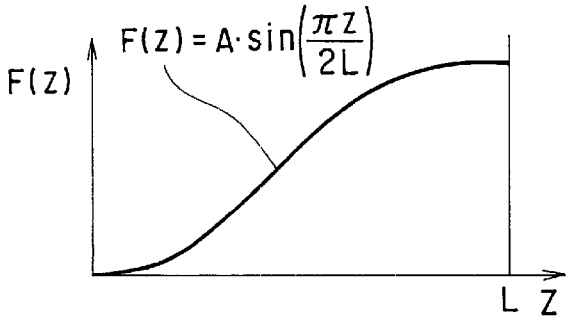

As shown in FIG. 5B, the function corresponds to:

$$F(z)=A\cdot\sin(\pi z/2L)$$

Figure 5C:
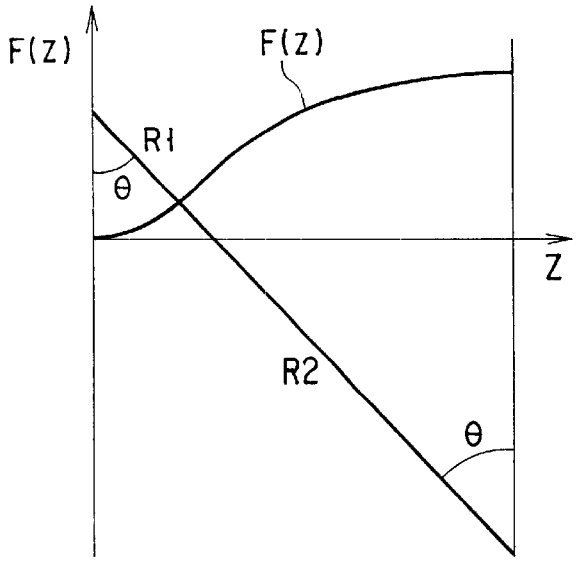

Moreover, as shown in FIG. 5C, the function corresponds to a shape of two arranged circular arcs.

Figure 6:
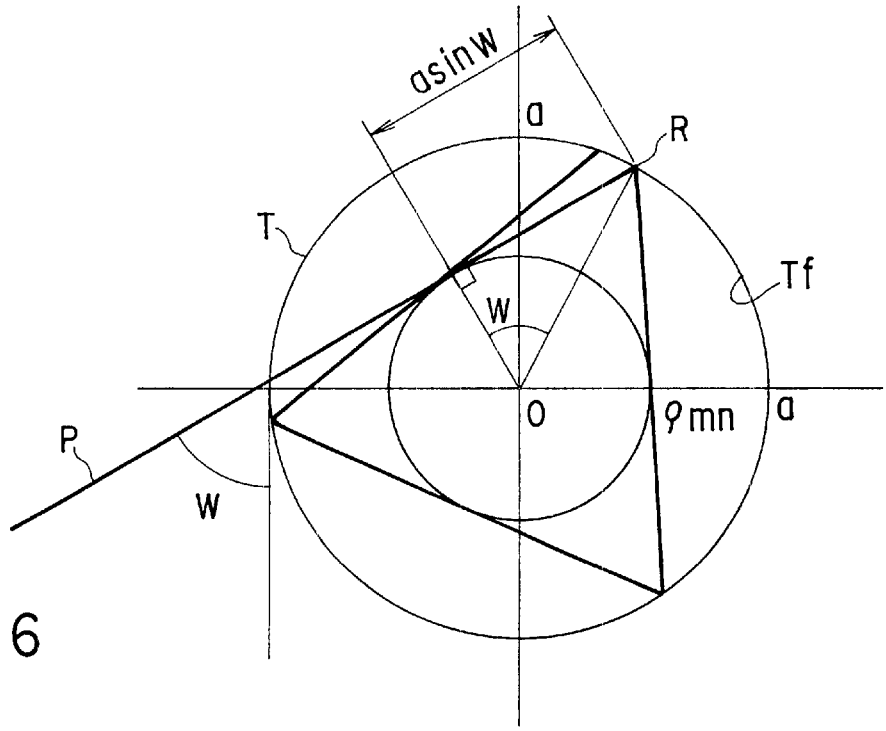
FIG. 6 is an explanatory plan view showing a change of a section of a diametric direction of the circular waveguide in the mode converter shown in FIG. 2.
Figure 7:
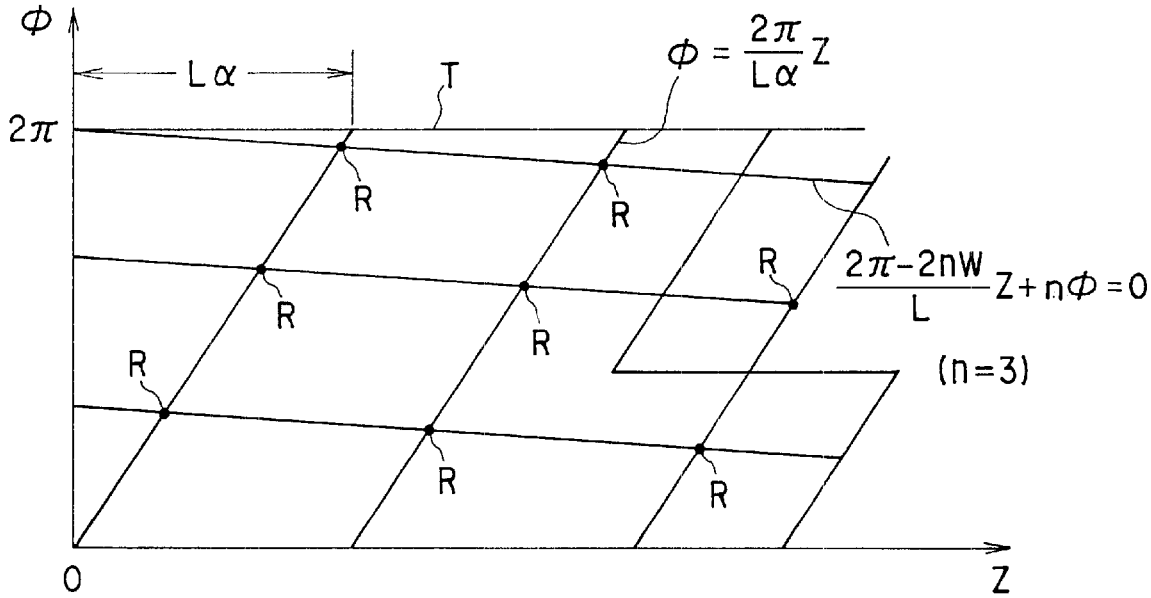
FIG. 7 is a plan view schematically showing the concave/convex state of the circular waveguide of the mode converter shown in FIG. 2 in the developing manner in the azimutual direction with the contour lines.

Furthermore, for the constant H, as shown in FIG. 6 and FIG. 7 and as described later, it is assumed that $\pi$ denotes the a circular constant, m denotes a azimutual direction mode number of an input mode, x denotes an inherent value of the input mode, k denotes an input wave number, W denotes arc cos (m/x), B denotes arc sin (x/(k·a)), and L denotes 2·a·sin W/tan B.

As described above, the radius is defined by the following:

$$r=a+F(z)\cdot\cos(H\cdot z+n\cdot\phi).$$

On the other hand, the constant H is defined by the following:

$$H=(2\cdot\pi-2\cdot n\cdot W)/L.$$

Moreover, the concave/convex shape whose deformation degree gradually increases in the propagation direction is obtained as follows.

As shown in FIG. 6 and FIG. 7, when a circular waveguide T having a radius a is considered, a rotation $TE_{m,n}$ mode wave propagated in the tube is developed with a plane wave. The wave can be represented as a group or rays reflected by a waveguide inner surface Tf while keeping a constant angle with the tube axis of the waveguide, and advancing in a helical shape. When k denotes an input wave free space length, and x denotes an input wave mode inherent value, kc denotes an in-tube wavelength, kc=x/a results, and an angle B formed by the waveguide tube axis with the ray group is represented by:

$$B=\sin^{-1}(kc/k).$$

Additionally, millimeter waves are emitted via the end of the circular waveguide T, and radiated in the direction in which the angle B is formed with the waveguide tube axis. Therefore, the angle B is referred to as an axial direction angle of the millimeter waves radiation.

The ray group forms an envelope cylindrical surface F with a radius $\rho_{mn}$ in the waveguide. Here, when m denotes the azimutual direction mode number of the input mode, a relation of the radius $\rho_{mn}$ of the envelope cylindrical surface with m is represented as follows.

$$\rho_{mn}/a=m/k_c a=m/x$$

Moreover, an angle W is formed by the waveguide inner surface Tf with a ray P in an intersection point of the ray P with the waveguide inner surface Tf, that is, in a reflection point R. The angle is represented as follows.

$$W=\cos^{-1}(\rho_{mn})=\cos^{-1}(m/x)$$

Furthermore, when the ray P advances from the reflection point R by the angle W, an advancing distance Lw of the axial direction is represented as follows.

$$Lw=a\cdot\sin W/\tan B$$

Therefore, an axial direction distance $L\alpha$ by which the ray P advances during one rotation in the azimutual direction is represented as follows.

$$L\alpha=2\cdot\pi\cdot\alpha\cdot\sin W/W\cdot\tan B$$

Moreover, when a certain one ray P is noted among the group of rays, a relation between the reflection point R and the next reflection point R for reflecting the ray P on the waveguide inner surface Tf corresponds to angle 2W in the azimutual direction, and to L in the axial direction in a cylindrical coordinate system having one point of the waveguide tube axis as an origin. The relation is represented as follows.

$$L=2\cdot a\cdot\sin W\cdot\tan B$$

Furthermore, to set all reflection points R of the ray P to thread crests (or grooves), there are two methods. In one method, the waveguide inner surface Tf is formed in a thread shape such that both an inclination and a pitch agree with a helical thread crest (or groove) for connecting the reflection points R of the ray P to one another. In another method, only the thread shape pitch is matched with an interval of the reflection points R of the ray P and the inclination is varied.

Here, inner surface radius r of a circular waveguide T is as follows.

$$r=a+F(z)\cos(Hz+n\phi)$$

In this case, with $H=2\pi/L\alpha$, and $n=-\pm1$, the thread groove can be allowed to agree with the helix for connecting the reflection points R of the ray P to each other. Therefore, the millimeter waves can gradually be converted to a periphery of one helix (mainly in the axial direction).

Therefore, an output end of the radiation aperture is formed in a helical cut portion removed from the periphery of one helix to which the millimeter waves converges. Then, an energy density can be minimized, and diffraction and scattering effect of the millimeter waves can be minimized.

Moreover, with $H=(2\pi-2nW)/L$, the waveguide inner surface Tf is formed such that the reflection point R of one ray P is constantly in a crest position. Therefore, the millimeter waves can gradually be converted to the periphery of the thread crest mainly in the azimutual direction. When there is a concave/convex in the azimutual direction, the wave is converged to the crest position, and converged to a groove position in the axial direction.

Therefore, as shown in FIG. 7, the output end of the radiation aperture 23 is formed as a straight cut portion of the groove position, so that the energy density and the diffraction and scattering effect of the millimeter waves can be minimized. Additionally, FIG. 8 is millimeter waves electric field strength distribution diagram showing that the millimeter waves obtained by the aforementioned calculation method converges to the periphery of the thread crest.

Moreover, in order to obtain the monotonous increase function F(z) in more detail, when two monotonous increase functions $F_1(z)$, $F_2(z)$ are considered, the aforementioned numeric values and constants can more precisely be defined. When the inlet radius a, tube axial direction coordinate z, azimutual direction coordinate $\phi$, monotonous increase functions $F_1(z)$, $F_2(z)$, constants $H_1$, $H_2$ and integers $n_1$, $n_2$ are used, the circular waveguide inner surface radius r can be represented by the following.

$$r=a+F_1(z)\cdot\cos(H_1\cdot z+n_1\cdot\phi)+F_2(z)\cdot\cos(H_2\cdot z+n_2\cdot\phi)$$

In this case, it is assumed that $\pi$ denotes the circular constant, m denotes the azimutual direction mode number of the input mode, x denotes the inherent value of the input mode, k denotes the input wave number, W denotes arc cos (m/x), B denotes arc sin (x/(k·a)), L denotes 2a sin W/tan B, and $L_\alpha$ denotes $2\pi \cdot a \cdot \sin W/(W \tan B)$. Then, the constants are defined as follows.

$$H_1=2\pi/L_\alpha$$

$$H_2=(2\pi-2n_2W)/L$$

The gyrotron tube according to a second embodiment of the present invention will next be described with reference to FIG. 9 and FIG. 10.

Figure 9:
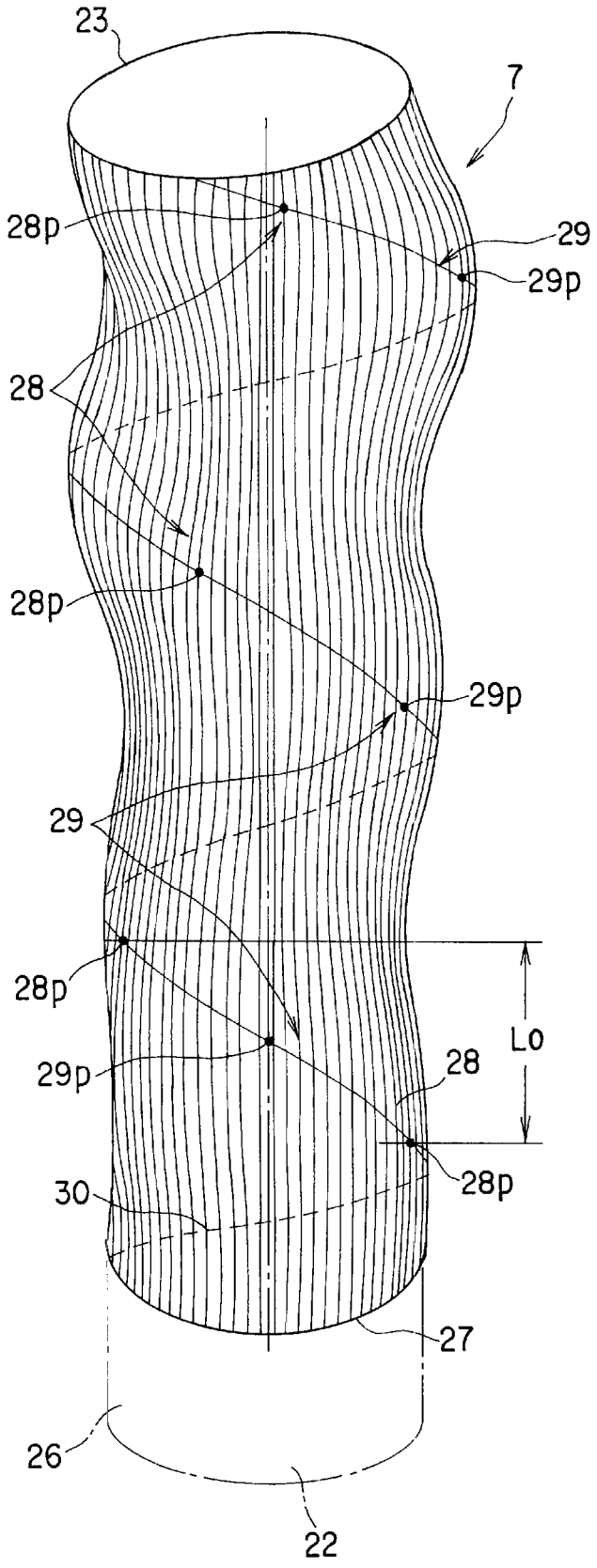
FIG. 9 is a perspective view schematically showing the circular waveguide of the mode converter according to a second embodiment of the present invention which is applied to the gyrotron tube shown in FIG. 1.

FIG. 9 is a perspective view schematically showing the inner surface shape of the substantially cylindrical waveguide constituting the mode converter 7 according to the second embodiment of the present invention, and linearly shows the inner surface shape and the surface concave/convex in an emphasized manner. FIG. 10 is a plan view showing the inner surface shape of the substantially cylindrical waveguide constituting the mode converter 7 in the developing manner in the azimutual direction with the contour lines, and shows the concave/convex in an emphasized manner similarly as FIG. 9.

Figure 10:
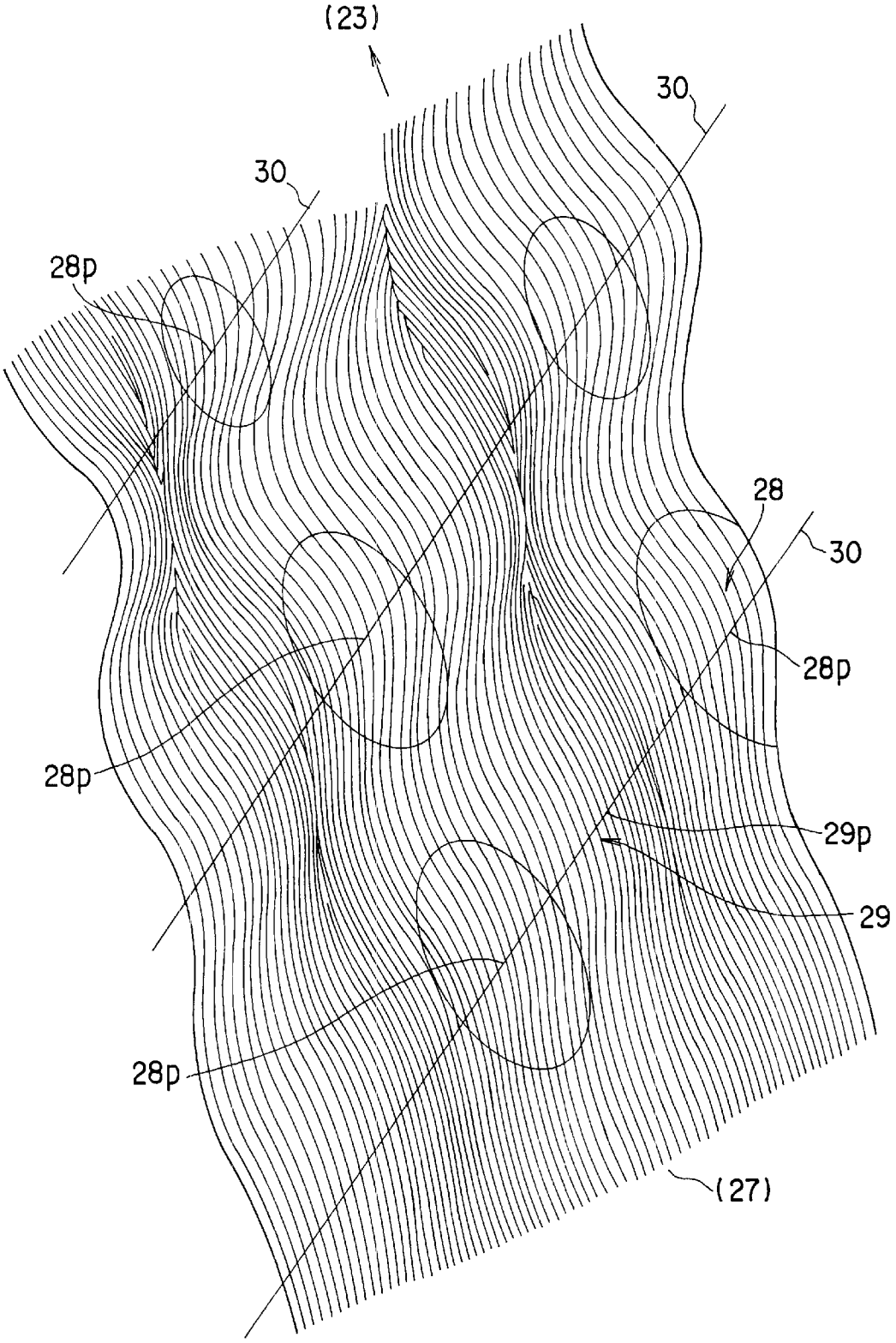
FIG. 10 is a plan view schematically showing the concave/convex state of the circular waveguide of the mode converter shown in FIG. 9 in the developing manner in the azimutual direction with the contour lines.

In FIG. 9 and FIG. 10, the substantially cylindrical waveguide constituting the mode converter has a substantially cylindrical inner surface shape, and an inner sectional shape of the virtual inlet side 22 is formed in a true circular shape.

For the waveguide, the inner surface shape of the substantially cylindrical waveguide is formed toward the radiation aperture 23 from the virtual inlet side 22 such that the deformation degree of the concave/convex of the azimutual direction from the circular shape gradually increases in the propagation direction.

The actual inlet side 27 of the substantially cylindrical waveguide constituting the mode converter 7 is connected to the previous-stage circular tapered waveguide (not shown). The higher-mode millimeter waves inputted via the inlet side is converged by the concave/convex of the converter inner wall surface shown in FIG. 9, FIG. 10, and is emitted via the radiation aperture 23.

As described above, in the prior art 1, to continuously connect the mode converter to the cylindrical tapered waveguide 6, the true circular shape is formed, for example, over 10 mm or more from the inlet side 27 of the substantially cylindrical waveguide constituting the mode converter 7. Therefore, the region in the vicinity of the inlet side has a true circular shape, or has a small deformation degree from the true circular shape. There is a possibility that the cavity resonator is constituted and that the parasitic oscillation is caused.

On the other hand, in the waveguide according to the second embodiment shown in FIG. 9 and FIG. 10, similarly as the first embodiment, the region 26 in the vicinity of the inlet side 27 of the substantially cylindrical waveguide constituting the mode converter 7 is cutout by a predetermined length from the virtual inlet side 22. Thereby, the region in which the deformation degree from the true circular shape is small is set to be as short as 5 mm or less. Therefore, in the waveguide having this structure, the possibility that the cavity resonator is constituted and undesirable parasitic oscillation is caused can be reduced. Additionally, in FIG. 9 and FIG. 10, in the substantially cylindrical waveguide constituting the mode converter 7, a converging mirror 28 having a plurality of apexes 28*p* and a diverging mirror 29 having a plurality of apexes 29*p* are arranged in order on a bus bar of a helical circular 30.

In the substantially cylindrical waveguide constituting the mode converter 7, the actual inlet side 27 has a non-true circular shape and does not have a true circular shape. Therefore, discontinuity occurs in the surface of the waveguide connected to the previous-stage circular tapered waveguide. However, since the deformation degree from the true circular shape is small, it is possible to minimize reflection caused by the discontinuity and adverse influence caused by the mode conversion.

Additionally, the gyrotron tube can be constituted such that a part or the whole of the mode converter is disposed in the tube.

As described above, according to the present invention, the possibility that the vicinity of the inlet of the mode converter constitutes an undesirable cavity resonator is reduced, and the parasitic oscillation caused in the mode converter built in the gyrotron can be suppressed.

Moreover, while the total length of the mode converter limited by the interference with the electron beam locus is kept, the effective length can be increased. Therefore, the deformation amount per unit length is reduced, the beam is moderately converged, and the mode conversion efficiency can be improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A mode converter comprising:

a substantially circular waveguide including an inlet for introducing millimeter waves of a higher mode, a radiation aperture for emitting the converted millimeter wave beam, and a transverse inner surface shaped such that a deformation degree to a non-true circular shape from a substantially true circular shape gradually is increased toward the radiation aperture from an inlet side of the millimeter waves, so that the higher-mode millimeter waves propagated in said circular waveguide is converted to millimeter wave beam propagated in a free space, wherein a region of said circular waveguide changing to the non-true circular transverse inner surface shape is in a range of 0 to 5 mm toward said radiation aperture from said inlet side.

2. The mode converter according to claim 1, wherein the transverse inner surface shape of said circular waveguide is the non-true circular shape on said inlet side.

3. The mode converter according to claim 2, wherein for the inner surface shape of the region of said circular waveguide whose transverse inner surface shape is the non-true circular shape, an inlet radius a, a tube axial direction coordinate z, an azimutual direction coordinate $\phi$, a monotonous increase function F(z), a constant H, and an integer n are used, and then a circular waveguide inner surface radius r is represented by:

$$r=a+F(z)\cdot\cos(H\cdot z+n\cdot\phi).$$

4. The mode converter according to claim 3, wherein said constant H is represented by:

$$H=(2\cdot\pi-2\cdot n\cdot W)/L,$$

in which $\pi$ denotes a circular constant, n denotes an integer, W denotes arc cos (m/x), m denotes an azimutual direction mode number of an input mode, x denotes an inherent value of the input mode, L denotes 2a·sin W/tan B, B denotes arc sin (x/(k·a)), and k denotes a wave number of an input wave.

5. The mode converter according to claim 1, wherein for the inner surface shape of said circular waveguide having the region whose transverse inner surface shape is the true circular shape on said inlet side of the circular waveguide, an inlet radius a, a tube axial direction coordinate z, a peripheral direction coordinate ϕ, monotonous increase functions $F_1(z)$, $F_2(z)$, constants $H_1$, $H_2$, and integers $n_1$, $n_2$ are used, and then a circular waveguide inner surface radius r is represented by:

$$r = a + F_1(z)\cdot\cos(H_1\cdot z + n_1\cdot\phi) + F_2(z)\cdot\cos(H_2\cdot z + n_2\cdot\phi).$$

6. The mode converter according to claim 5, wherein said constants $H_1$ and $H_2$ are represented by:

$$H_1=2\cdot\pi/L_\alpha,$$

$$H_2=(2\cdot\pi-2\cdot n_2 W)/L,$$

in which π denotes a circular constant, $L_\alpha$ denotes 2π·a·sin W/(W·tan B), W denotes arc cos (m/x), m denotes an azimutual direction mode number of an input mode, x denotes an inherent value of the input mode, B denotes arc sin (x/(k·a)), k denotes a wave number of an input wave, $n_2$ denotes an integer, and L denotes 2·a·sin W/tan B.

7. A gyrotron tube comprising:

a magnetron injection gun for generating a hollow electron beam moving in a helical shape;

a collector for catching the electron beam from the magnetron injection gun;

a beam tunnel, disposed between the magnetron injection gun and the collector, for guiding an electron from the magnetron injection gun;

a cavity resonator, disposed between the beam tunnel and the collector, in which a high-frequency electric field is generated and an electromagnetic waves of a higher mode is generated by an interaction of the high-frequency electric field with the electron beam from the beam tunnel;

a mode converter, disposed between the cavity resonator and the collector, for converting the electromagnetic waves from the cavity resonator to a beam-like electromagnetic waves;

a cylindrical tapered waveguide, disposed between the mode converter and the cavity resonator, for guiding the electromagnetic waves from the cavity resonator to the mode converter; and guide means for guiding the beam-like electromagnetic waves from the mode converter to the outside of the gyrotron tube, wherein said mode converter comprises a substantially circular waveguide including an inlet for introducing millimeter waves of higher mode, a radiation aperture for emitting the converted millimeter wave beam, and a transverse inner surface shaped such that a deformation degree to a non-true circular shape from a true circular shape is gradually increased toward the radiation aperture from an inlet side of the millimeter waves, so that the higher-mode millimeter waves propagated in said circular waveguide is converted to millimeter wave beam propagated in a mirror system in a free space, and a region of said circular waveguide changing to the non-true circular transverse inner surface shape is in a range of 0 to 5 mm toward said radiation aperture from said inlet side.

8. The gyrotron tube according to claim 7, wherein the transverse inner surface shape of said circular waveguide is the non-true circular shape on said inlet side.

9. The gyrotron tube according to claim 8, wherein for the inner surface shape of the region of said circular waveguide whose transverse inner surface shape is the non-true circular shape, an inlet radius a, a tube axial direction coordinate z, a peripheral direction coordinate ϕ, a monotonous increase function F(z), a constant H, and an integer n are used, and then a circular waveguide inner surface radius r is represented by:

$$r=a+F(z)\cdot\cos(H\cdot z+n\cdot\phi).$$

10. The gyrotron tube according to claim 9, wherein said constant H is represented by:

$$H=(2\pi-2\cdot n\cdot W)/L,$$

in which π denotes a circular constant, n denotes an integer, W denotes arc cos (m/x), m denotes an azimutual direction mode number of an input mode, x denotes an inherent value of the input mode, L denotes 2a·sin W/tan B, B denotes arc sin (x/(k·a)), and k denotes a wave number of an input wave.

11. The gyrotron tube according to claim 7, wherein for the inner surface shape of said circular waveguide having the region whose transverse inner surface shape is the true circular shape on said inlet side of the circular waveguide, an inlet radius a, a tube axial direction coordinate z, a peripheral direction coordinate ϕ, monotonous increase functions $F_1(z)$, $F_2(z)$, constants $H_1$, $H_2$, and integers $n_1$, $n_2$ are used, and then a circular waveguide inner surface radius r is represented by:

$$r = a + F_1(z)\cdot\cos(H_1\cdot z + n_1\cdot\phi) + F_2(z)\cdot\cos(H_2\cdot z + n_2\cdot\phi).$$

12. The gyrotron tube according to claim 11, wherein said constants $H_1$ and $H_2$ are represented by:

$$H_1=2\cdot\pi/L_\alpha,$$

$$H_2=(2\pi-2n_2 W)/L,$$

in which π denotes a circular constant, $L_\alpha$ denotes 2π·a·sin W/(W·tan B), W denotes arc cos (m/x), m denotes an azimutual direction mode number of an input mode, x denotes an inherent value of the input mode, B denotes arc sin (x/(k·a)), k denotes a wave number of an input wave, $n_2$ denotes an integer, and L denotes 2·a·sin W/tan B.

* * * * *

UNITED STATES PATENT AND TRADEMARK OFFICE

CERTIFICATE OF CORRECTION

PATENT NO. : 6,476,558 B2
DATED : November 5, 2002
INVENTOR(S) : Sakamoto et al.

It is certified that error appears in the above-identified patent and that said Letters Patent is hereby corrected as shown below:

Title page,
Item [73], Assignee, please insert second Assignee to read -- Japan Atomic Energy Research Institute, Tokyo (JP) --.
Please insert item:
-- [30] Foreign Application Priority Data
May 29, 2000 (JP) …… 2000-158729 --.

Signed and Sealed this

Fourth Day of November, 2003

JAMES E. ROGAN
*Director of the United States Patent and Trademark Office*